US005117265A

United States Patent [19]

Matsui et al.

[11] Patent Number: 5,117,265

[45] Date of Patent: May 26, 1992

[54] COPYING APPARATUS HAVING A SINGLE EXPOSURE PORTION FOR FINAL ORIGINALS AND NON-FINAL ORIGINALS EXPOSURE IN COMPOSITE COPYING OPERATIONS

[75] Inventors: Toru Matsui; Kadotaro Nishimori, both of Osaka, Japan

[73] Assignee: Minolta Camera Kabushiki Kaisha, Osaka, Japan

[21] Appl. No.: 538,683

[22] Filed: Jun. 15, 1990

Related U.S. Application Data

[63] Continuation of Ser. No. 191,916, May 9, 1988, abandoned.

[30] Foreign Application Priority Data

May 11, 1987 [JP] Japan ..... 62-113773

[51] Int. Cl.[5] ..... G03G 21/00

[52] U.S. Cl. ..... 355/313; 355/319

[58] Field of Search ..... 355/313, 318, 319, 200, 355/210, 314

[56] References Cited

U.S. PATENT DOCUMENTS

| | | | |
|---|---|---|---|
| 4,278,344 | 7/1981 | Sahay | 355/319 |
| 4,291,341 | 9/1981 | Yajima | 355/202 X |
| 4,385,825 | 5/1983 | Kaneko | 355/319 |
| 4,537,497 | 8/1985 | Masuda | 355/313 |
| 4,743,945 | 5/1988 | Ito et al. | 355/244 |

FOREIGN PATENT DOCUMENTS 62-11865 1/1987 Japan .

*Primary Examiner*—Fred L. Braun

*Attorney, Agent, or Firm*—Burns, Doane, Swecker & Mathis

[57] ABSTRACT

A copying apparatus produces a composite copy from an original document having a plurality of sheets and a final sheet having a desired format or overlay. The original document and the final format sheet are placed together in the same sheet feeding device. The format sheet is the last sheet in the sheet feeding device. The original sheets are fed to a printing device having a single exposure section. Images on the original sheets are copied onto blank paper which is fed to the printing device from a first paper location. The copies of the original documents are then sent to a second or intermediate paper location. The final sheet having the desired overlay or format is then fed to the same exposure section of the printing device. The copies of the original documents which are stored in the second paper location are then fed to the printing device, and the image on the format sheet is copied onto the paper received from the second paper location. The finished composite copies are then exited from the copying apparatus. The finished composite copies include images from both the original sheets and the format sheet.

17 Claims, 18 Drawing Sheets

| FIG. 11A | FIG. 11B | FIG. 11C | FIG. 11D |
|---|---|---|---|

A
OPERATION M2 FLAG = 1
S610
NO
B
YES
TIMER A JUDGED?
S620
NO
YES
S630
1ST FEED ROLLER CL ← OFF
2ND FEED ROLLER CL ← OFF
REFEED ROLLER CL ← OFF
TIMER B JUDGED?
S640
NO
YES
S650
SCAN SIGNAL ← 1
TIMING SIGNAL = 1?
S660
NO
YES
S670
TIMING ROLLER CL ← ON
TIMER C SET
TIMER C JUDGED?
S680
NO
YES
S690
TIMING ROLLER CL ← OFF
SCAN SIGNAL ← 0
EXPOSURE LAMP ← OFF
CORONA CHARGER ← OFF
S700
OPERATION M2 FLAG ← 0
OPERATION M3 FLAG ← 1
RETURN

| FIG. 12A | FIG. 12B |
|---|---|

COPYING APPARATUS HAVING A SINGLE EXPOSURE PORTION FOR FINAL ORIGINALS AND NON-FINAL ORIGINALS EXPOSURE IN COMPOSITE COPYING OPERATIONS

This application is a continuation of application Ser. No. 07/191,916, filed May 9, 1988, now abandoned.

BACKGROUND OF THE INVENTION

1. Field of the Invention

The present invention relates to a copying apparatus and, more specifically, it relates to a copying apparatus capable of composite copying.

2. Description of the Prior Art

A copying apparatus is capable of composite copying for copying several images on one sheet of a copying paper. Overlay copying for copying predetermined format such as ruled lines, framing, company name, telephone number, cut and the like on sheets of the same or the different originals can be performed by using the above described copying apparatus.

However, if a prescribed original is not properly positioned on an original glass plate of the copying apparatus, the image of the composite copying of the above mentioned framing or the like may be inclined or blurred. The setting of the said original is not always easy, since it must be carried out considering the relation with the copied image on the copy paper. In addition, the setting of the composite copying mode is not easily carried out. As described above, there are several problems to be solved.

One example which solved the above described problems is disclosed in the U.S. Pat. No. 4,537,497 entitled "Image Recording Apparatus". FIG. 1 is a cross sectional view of a copying apparatus capable of overlay copying disclosed therein.

With reference to FIG. 1, a conventional copying apparatus capable of overlay copying comprises first exposure means 501 for exposing a format original OB, second exposure means 502 for exposing originals OS having a content to be written in the format, an image forming section 503 for forming a latent image of the originals and transferring the same to a transfer sheet, and an intermediate tray 506 for storing the transfer sheet. The above described copying apparatus can compose a format original OB and other originals OS.

The image composing procedure of the conventional copying apparatus is as follows.

(1) One format original OB is set in the first exposure means and a prescribed N originals OS are set in the second exposure means.

(2) The number of copies N is set and a print switch is turned on.

(3) N copies of the format original OB are formed and stored in the intermediate tray 506.

(4) Images of the originals OS are formed on the sheets in the intermediate tray 506.

The conventional copying apparatus capable of overlay copying is structured as described above. Therefore, it has the following problems.

First, two exposure means of different types are required.

Second, it is capable of only one set (N) composite copying at one time.

Third, the number of copies N should be coincident with the number of the originals OS, so that the number of the original must be counted in advance.

SUMMARY OF THE INVENTION

Therefore, one object of the present invention is to provide a copying apparatus capable of composite copying using one exposure means.

Another object of the present invention is to provide a copying apparatus capable of producing a plurality sets of composite copy sheets at one time.

A further object of the present invention is to provide a copying apparatus capable of producing a plurality of composite copy sheets without inputting the number of copies in advance.

A still further object is to provide a copying apparatus in which a format original having a prescribed format can be composite copied to a plurality of other originals.

A still further object is to provide a copying apparatus in which composite copy sheets having a prescribed format can be automatically produced by setting a format original and other originals in a prescribed position of the copying apparatus.

A still further object is to provide a method for composite copying capable of producing a plurality of composite copy sheets at one time.

The above described objects of the present invention can be attained by a copying apparatus comprising: original placing means for containing a plurality of originals, wherein the plurality of originals include a final original and other originals; copying means for forming an image of the original on a copy paper, the copying means having an exposure portion for exposing the original; original feeding means for feeding originals on the original mounting means one by one to the exposure position; paper feeding means for containing papers which have not yet been copied and for feeding the papers to the copying means one by one; paper re-feeding means for containing copied papers with the images formed thereon by the copying means and for feeding the copied papers to the copying means one by one; and control means for activating the paper feeding means when the originals other than the final original is copied and for activating the paper re-feeding means when the final original is copied.

Since the copying apparatus comprises the above described components, a copying apparatus can be provided which is capable of composite copying using one exposure means.

According to a preferred embodiment, the above described paper re-feeding means feeds a copied paper to the copying means so that the copy of the final original and that of other originals are formed on the same side.

Since the copying apparatus comprises the above described components, a format original having a prescribed format can be composite copied with a plurality of other originals.

In a more preferred embodiment of the present invention, the copying apparatus comprises a counter for counting the number of originals fed by the original feeding means.

Since the copying apparatus comprises the above described component, a copying apparatus can be provided which is capable of producing a plurality of composite copy sheets without inputting the number of copies in advance.

According to another preferred embodiment of the present invention, in a copying apparatus comprising: copying means having an exposure portion for exposing an original and an image forming portion for forming an image of the original on a copy paper by exposing; original feeding means having an original placing portion for placing a plurality of originals for feeding the originals one by one to the exposure portion; paper feeding means for feeding copy papers to the image forming portion; storing means for temporarily storing copy papers with the images formed thereon; and paper re-feeding means for feeding the copy papers in the storing means again to the image forming means; a method of composite copying comprises the steps of: feeding originals other than a final original one by one from the original placing portion to the exposure portion by the original feeding means; copying on the copy papers by feeding the copy papers of desired copy number (n) successively to the image forming means by the paper feeding means for each of the originals; storing the copied papers in the storing means; feeding the final original from the original placing portion to the exposure portion by the original feeding means; and feeding the copied papers stored in the storing means one by one to the image forming portion successively.

Since the method of composite copying comprises the above described steps, a method can be provided which is capable of producing a plurality of composite copy sheets at one time.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 2:
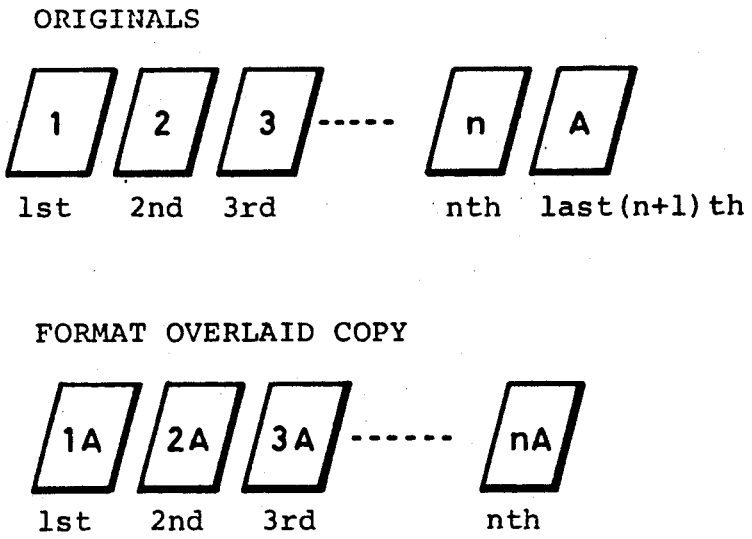
FIG. 2 shows the relation between the original and the copy paper when composite copying is carried out by a copying apparatus in accordance with the present invention.

FIG. 2 shows the relation between originals and composite copied papers which are composite copied by the copying apparatus in accordance with a present invention. The 1st to Nth originals are successively copied using an automatic document feeder (hereinafter referred to as ADF). Thereafter, the N+1th final original is composite copied commonly onto the 1st to Nth originals.

Such composite copying is defined as a format overlay copying in the present invention.

Figure 4:
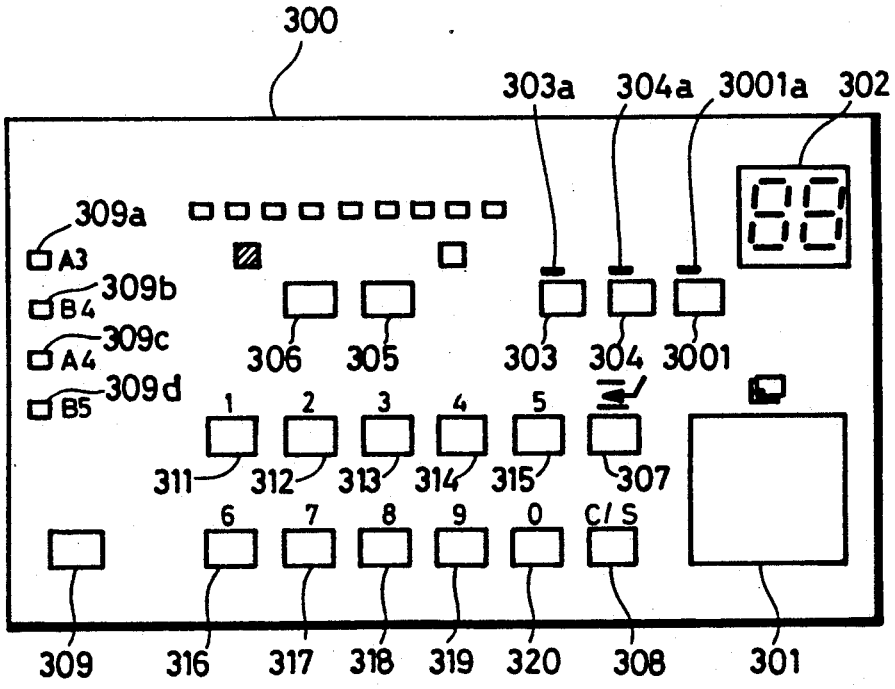
FIG. 4 shows an operation panel of the copying apparatus.
Figure 3:
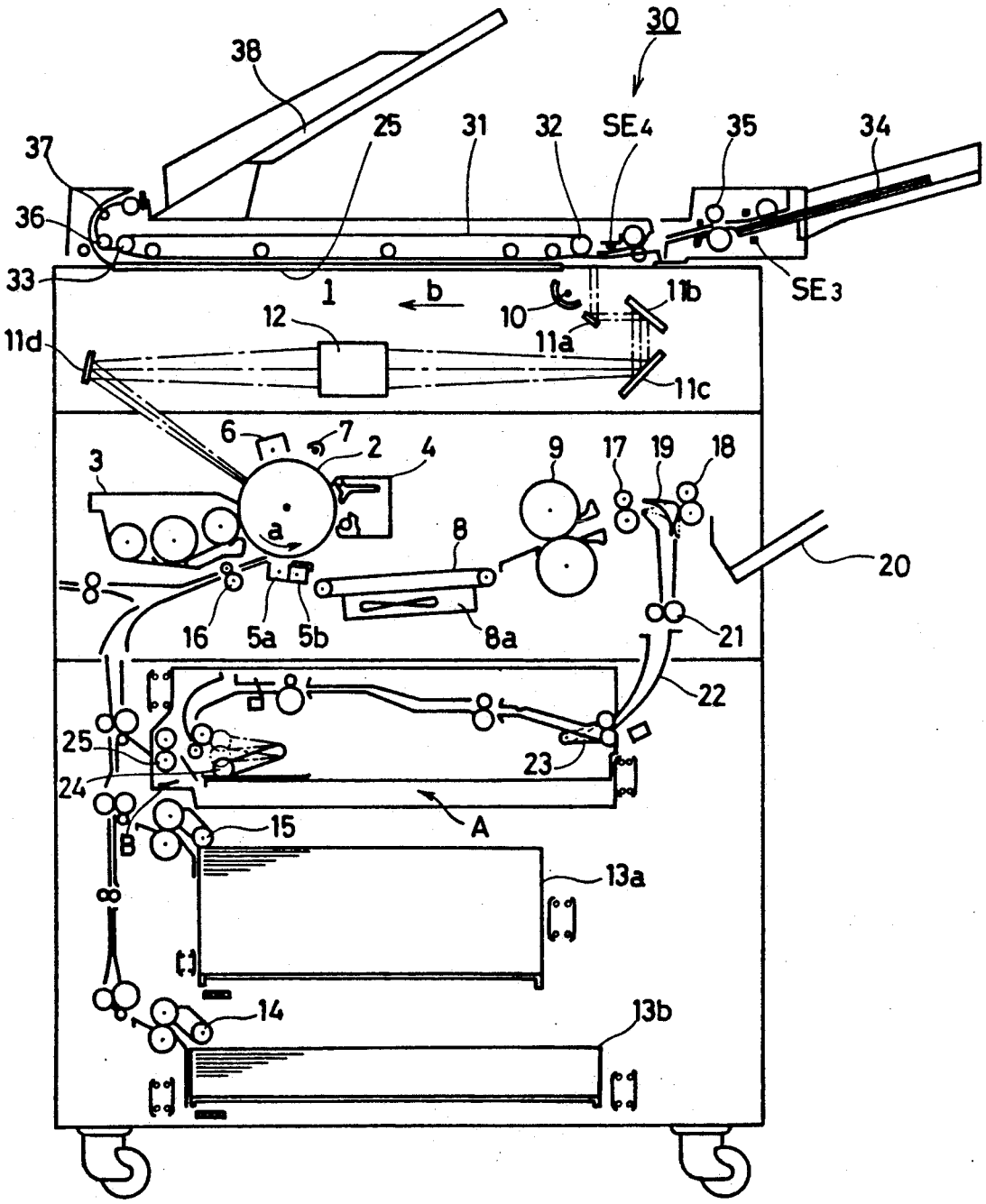
FIG. 3 shows a whole structure of the copying apparatus.
Figure 5:
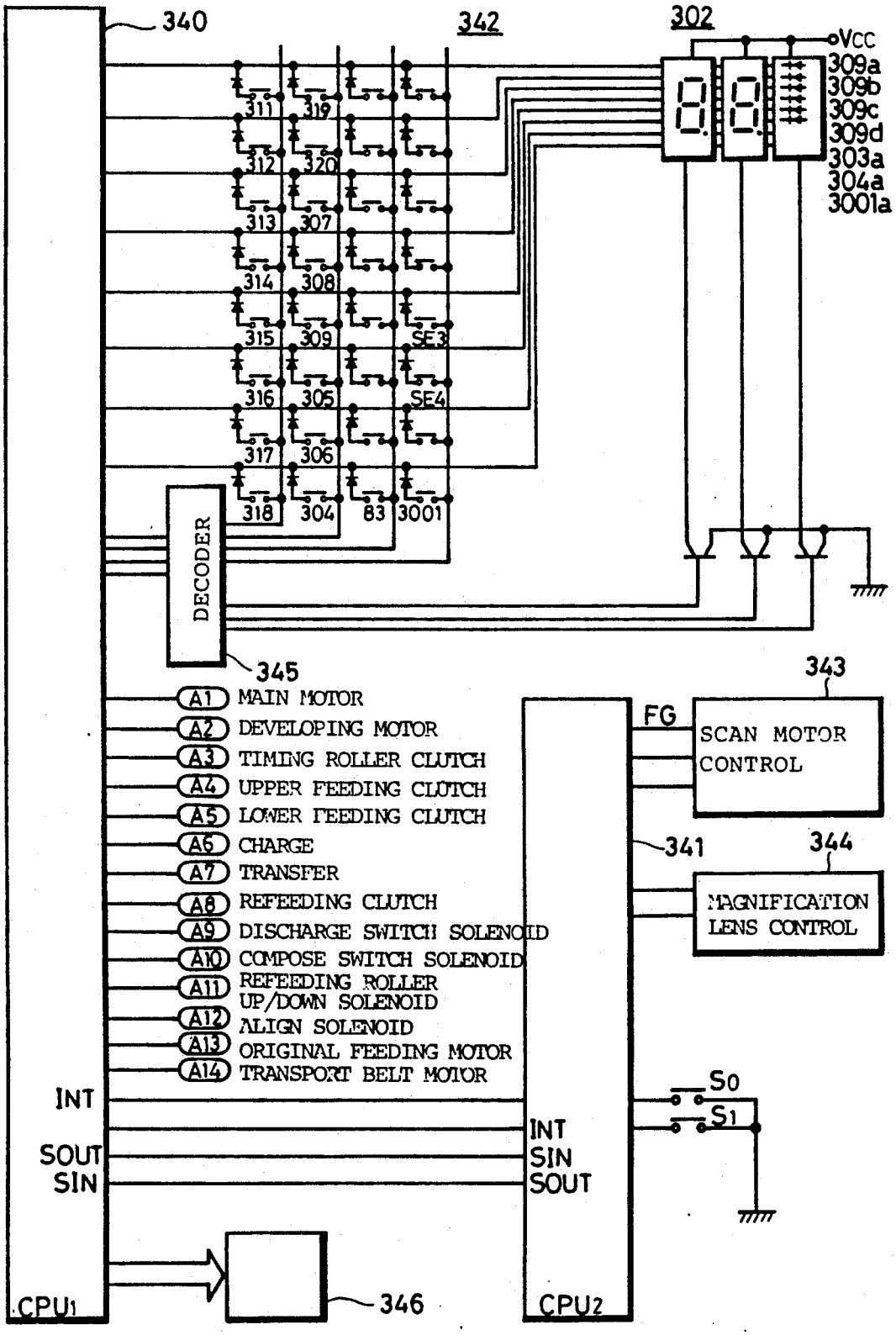
FIG. 5 shows the control circuit of the copying apparatus.

Referring to FIGS. 3 to 5, the whole structure and the control circuit of the copying machine for executing the present invention will be described.

(Whole Structure of the Copying Machine, FIG. 3)

First, the whole structure of the copying machine as well as the copying operation will be described.

The copying machine comprises a copy paper containing portion located in the lower section, an intermediate tray A located directly above the copy paper containing portion, an image forming portion including a photoreceptor drum 2 located in the intermediate section, and an optical system located in the upper section. A copy paper with an image formed thereon is fed to the intermediate tray A and is re-fed, thereby the composite copying and the format overlay copying are carried out.

The photoreceptor drum 2 is rotatable in the direction of the arrow a. A corona charger 6, a magnetic brush type developing device 3, a transfer charger 5*a*, a copy paper separation charger 5*b*, a blade type cleaning device 4 and an eraser lamp 7 are successively arranged around the photoreceptor drum. The photoreceptor drum 2 is uniformly charged by the corona charger 6 as it rotates in the direction of the arrow a, and a latent electrostatic image is formed by the image exposure from the optical system 1. The latent electrostatic image is developed into a toner image by the developing device 3.

The optical system 1 is capable of scanning in the direction of an arrow b below the original glass support 25. The optical system comprises an exposure lamp 10, movable mirrors 11*a*, 11*b* and 11*c*, an imaging lens 12 and a fixed mirror 11*d*. The exposure lamp 10 and the movable mirror 11*a* move integrally in the direction of the arrow b at the speed of (V/m) (m: copying magnification) with the peripheral speed of the photoreceptor drum 2 being V (which is constant regardless of the equal scale magnification or variable scale magnification), and movable mirrors 11*b* and 11*c* integrally move in the direction of the arrow b at the speed of V/2m).

The copy paper containing portion comprises an upper stage containing portion 13*a* and a lower stage containing portion 13*b*. A copy paper in the containing portion 13*a* is fed by the rotation of a roller 15 and a copy paper in the containing portion 13*b* is fed by the rotation of a paper feeding roller 14. Either the copy papers in the portion 13*a* or those in the portion 13*b* are selectively fed one by one and carried to the timing roller pair 16. The copy paper is temporarily stopped at the timing roller pair 16 and, thereafter, it is fed to the transfer portion in synchronization with the image formed on the photoreceptor drum 2. Consequently, by the discharge of the transfer charger 5*a*, the toner image is transferred onto the copy paper. The copy paper is separated from the surface of the photoreceptor drum 2 by the discharge of the separating charger 5b and is fed to the fixing device 9 by a transport belt 8 having an air suction means 8a. The toner image is heat fixed therein.

There are a transport roller pair 17 and a discharge roller pair 18 provided directly after the outlet of the fixing device 9 and a lever 19 is provided therebetween. If the copy paper should be discharged directly, the lever 19 is set at the position shown by the chain-dotted line in FIG. 2. The copy paper transported from the fixing device 9 is discharged from the discharge roller pair 18 onto the tray 20. If composite copying or format overlay copying is required (the details will be described later), the lever 19 is set at the position shown by the solid line. The copy paper is fed into the intermediate tray A from the transport roller pair 21 through a guiding plate 22. A switching lever 23 is provided at an outlet of the guiding plate 22. In case of composite copying or format overlay copying, the switching lever 23 is switched and the copy paper is fed from the rear portion of the intermediate tray A with the copied side turned down. The fed and stacked copy papers are aligned with the front end, rear end and both sides being regulated in the intermediate tray A. The copy papers are moved to the paper re-feeding opening B consisted by a paper re-feeding roller 24, delivering roller pair 25, and so on. The alignment and the movement of the copy papers in the tray A are disclosed in U.S. Ser. No. 06/833,144 filed on Jul. 8, 1986, now U.S. Pat. No. 4,743,945, by the applicant of the present invention.

The ADF (automatic document feeder) 30 is detachably provided on the upper surface of the body of the copying machine.

The ADF 30 comprises an original transporting belt 31 provided along an upper surface of the original glass plate 25 of the copying machine, driving rollers 32 provided on both sides of the belt, a guiding roller 33, original feeding roller pair 35 for feeding an original placed on an original tray 34 to the original transporting belt 31, a discharge roller pair 36, a discharge tray 38 for receiving originals discharged by a discharge guide 37, an original tray sensor SE3 provided in front of the original feeding roller pair 35 and an original sensor SE4 provided in front of the transporting belt 31.

The ADF 30 is electrically connected by placing the same on the body of the copying machine. Consequently, the control of the copying machine and the ADF 30 are associated with each other, so that the copying machine is operated by the ADF mode.

The ADF mode is the following operation mode. Namely, when a print key provided on the copying machine is operated, the copying machine remains in the standby state. The original feeding roller 35 and the original transporting belt 31 of the ADF start the operation. An original placed on the original tray 34 is fed in along the upper surface of the original glass plate 25 of the copying machine. The original is stopped at a prescribed position when a prescribed time period has passed after the top end thereof passed through the original sensor SE4. Thereafter, the copying operation starts. When a final scanning movement is finished for the original, the ADF 30 discharges the original onto the discharge tray 38. The original tray sensor SE3 provided in the original tray 34 detects whether the original is set at a prescribed position on the tray or not.

(Operation panel, FIG. 4)

Various operation keys provided on an operation panel 300 of the copying machine body will be described in the following with reference to FIG. 4.

The operation panel 300 comprises a print key 301 for starting copying operation, a numeral display device 302 capable of displaying numerals in two digits, ten keys 311 to 320 corresponding to the numerals "1", "2", . . . "9" and "0", an interruption key 307 for designating interruption of copying, a clear stop key 308, a copy paper size selection key 309 for designating the size of the copy paper contained in the containing portions 13a and 13b, up and down keys 306 and 305 for changing the designating concentration of copied images step by step, double side copying selection key 303, composite copying selection key 304 and format overlay copying selection key 3001, and so on.

Switches corresponding to the various operation keys and various sensors provided on the body of the copying machine and on the intermediate tray unit A are associated with the control circuit including a microcomputer system, as shown in FIG. 5.

(Control circuit, FIG. 5)

The control circuit of the copying apparatus will be described with reference to FIG. 5.

The control circuit comprises a first microcomputer 340 for controlling the copying operation and a second microcomputer 341 connected with each other so as to be synchronous with each other. A switch matrix 342 having various operation keys on the operation panel 300 and the sensors provided in the ADF arranged lengthwise and breadthwise is connected to the first CPU 340.

Output terminals A1 to A14 of the first CPU 340 are connected to a main motor, a developing motor, a toner supplying motor, paper feeding clutch, paper re-feeding clutch, switching solenoid of the levers 19 and 23, an original feeding motor, a transporting belt motor, and so on. The turning on/off of the above are controlled by signals from the switch matrix 342. Various light emitting elements (LED) such as the copy number display portion 302 are connected to the first CPU 340 through a decoder 342 to have their turning on/off controlled thereby.

A driving control portion 343 of a DC motor for the optical system scanning, a driving control portion 344 of the stepping motor for the magnification lens, a positioning switch $S_0$ of the optical system 1, a timing switch $S_1$, and so on are connected to the second CPU 341.

(Control Procedure, FIGS. 6 to 14)

Before describing the flow chart, the terms on edge and off edge will be defined.

When the states of a switch, sensor, signals and so on changes from the off state to the on state, this change of state will be defined as on edge.

When the state of the switch, sensor, signals and so on changes from the on state to the off state, the change of state is defined as off edge.

The operation procedure for operating the above described control circuit will be described in the following with reference to the flow charts of FIG. 6 and of the following figures.

Figure 6:
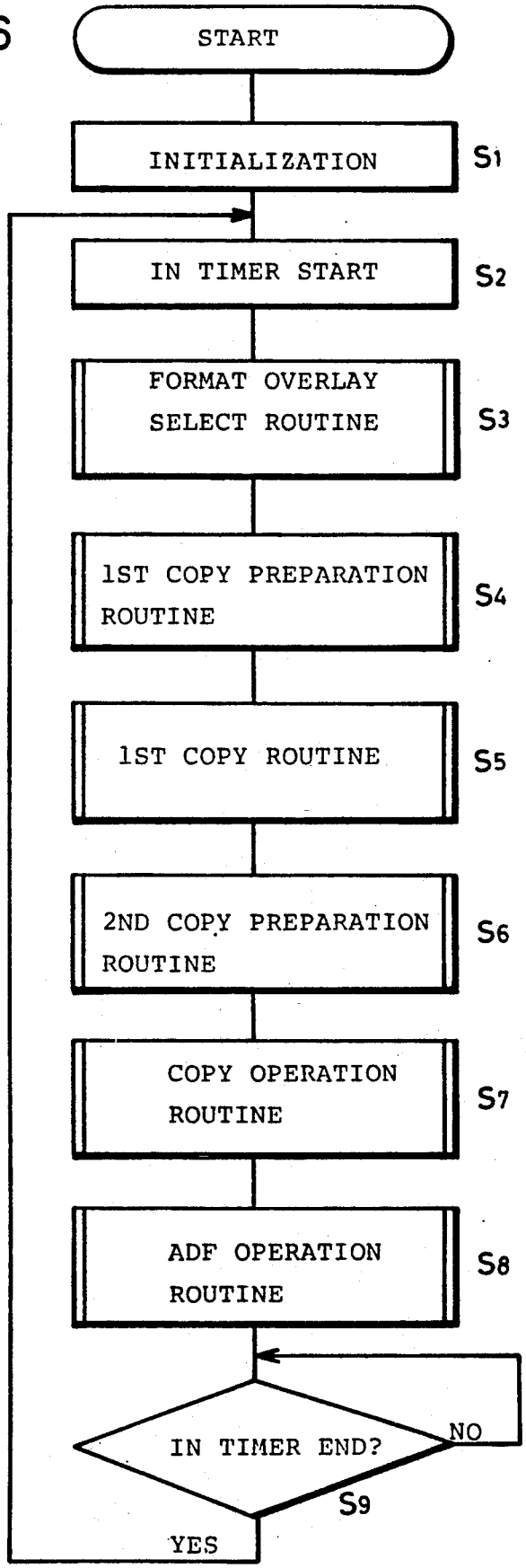
FIG. 6 is a flow chart showing a main routine of the control circuit.

FIG. 6 shows a main routine of the control. When the power is turned on, the CPUs 340 and 341 are reset to start the control. In the step S1, the CPUs 340 and 341 are initialized. Initialization for setting various equipments to the initial mode are carried out and each of the flags which will be described later is reset on this occasion. In the step S2, an internal timer is started. The internal timer is to define the processing time of one routine and is set at the step S1. Various timers described in the following subroutines determine the end of the set time by the count number of the internal timer.

Thereafter, each of the subroutines of the steps S3 to S8 is successively called. When the processing of all subroutines are completed, the processing flow returns to the step S2 when the said internal timer ends (S9).

The step S3 is a format overlay select routine for effecting the format overlay copying, step S4 is a first copy preparation routine for preparing the execution of the format overlay copying, and step S5 is a first copy routine for aligning copy papers fed onto the intermediate tray A. The step S6 is a second copy preparation routine for preparing paper re-feeding, the step S7 is a copy operation routine for effecting the copying operation, and the step S8 is an ADF operation routine for effecting the ADF operation.

Figure 7:
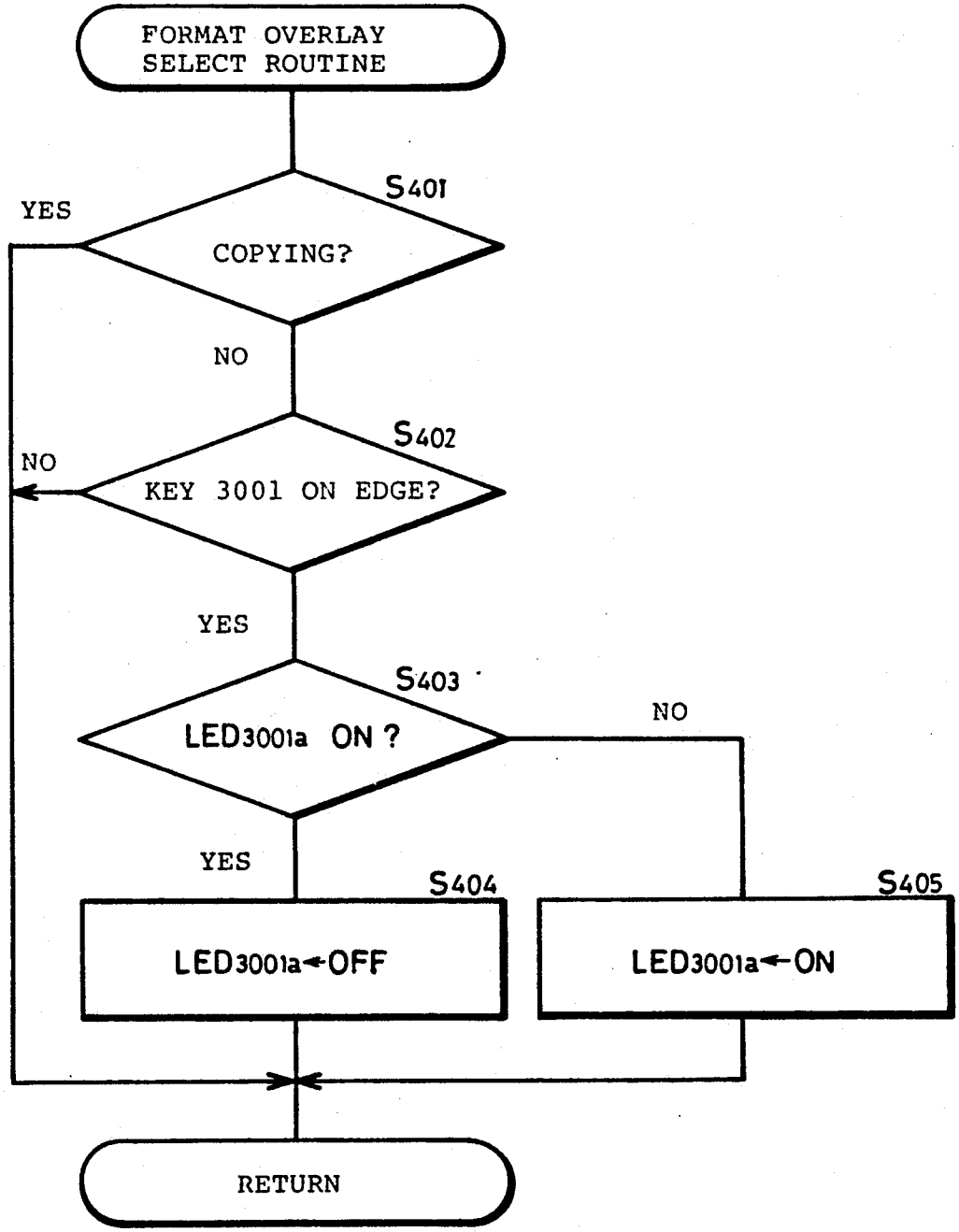
FIG. 7 is a flow chart showing a format overlay copying select routine.

FIG. 7 is a flow chart of the format overlay select routine. In the step S401, whether the copying operation is being carried out or not is determined. If the copying operation is being carried out, the routine is completed. On the contrary, if the copying operation is not being carried out, the on edge of the format overlay selection key 3001 is checked in the step S402. When the on edge is detected, whether the LED 3001*a* is on or not is determined in the step S403. If the LED 3001*a* is on, the LED 3001*a* is turned off in the step of S404, while if it is off, the LED 3001*a* is turned on in the step S405.

Figure 8:
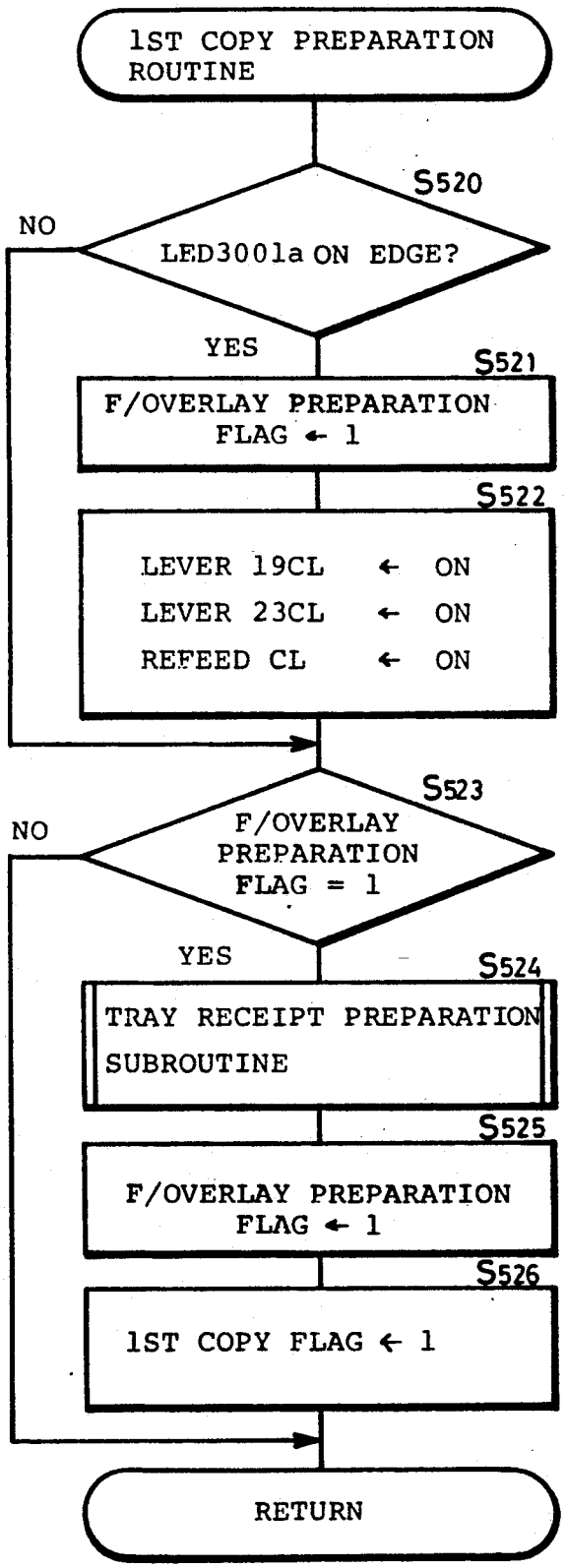
FIG. 8 is a flow chart showing a first copy preparation routine.

FIG. 8 shows the first copy preparation routine. When the on edge of the LED 3001*a* is detected in the step S520, a format overlay preparation flag is set at "1" in the step S521. The clutch of the levers 19 and 23, and a clutch of the paper re-feeding roller 24 are turned on, and the copy paper transporting path is switched to the transporting path for directly feeding to the intermediate tray A. Simultaneously, the paper re-feeding roller 24 is placed on the upper stage (step S522). Thereafter, if it is determined that the format overlay prepare flag is set at "1" in the step S523, an intermediate tray receiving preparation subroutine is called in the step S524. Preparation for receiving copy papers of a prescribed size is carried out and the format overlay preparation flag is reset to "0" in the step S525. The first copy flag is set at "1" in the step S526 and the first copy preparation routine ends.

Figure 9:
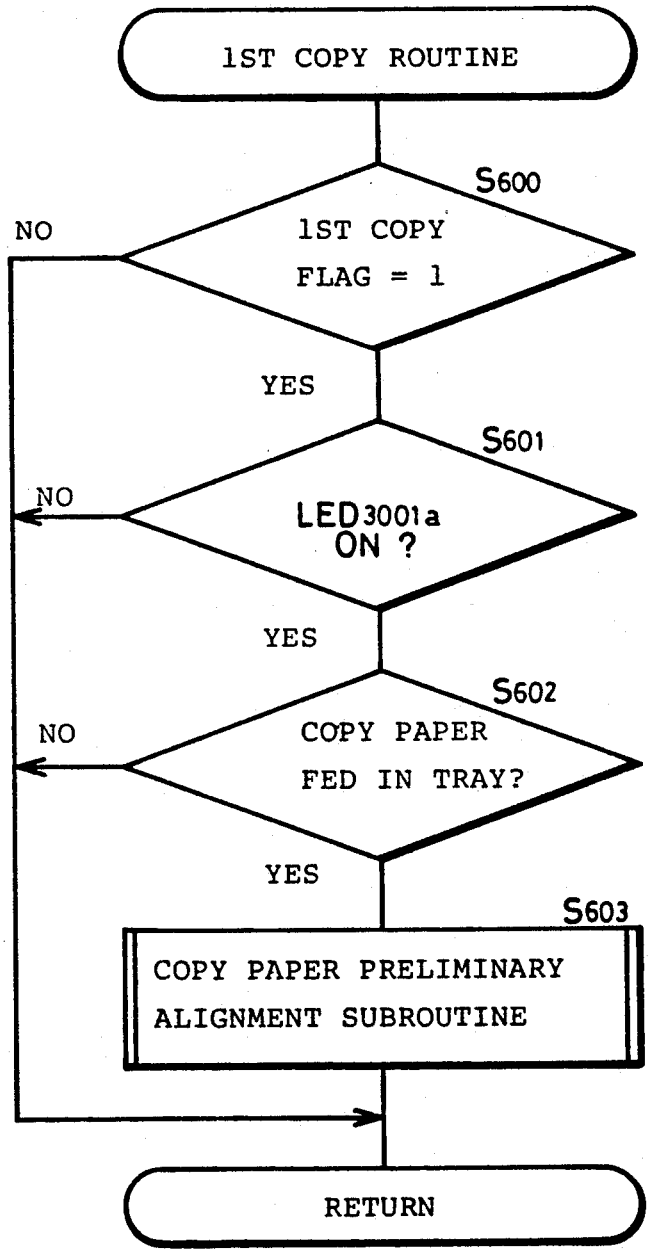
FIG. 9 is a flow chart showing the first copy routine.

FIG. 9 is a flow chart showing the first copy routine. This is a subroutine for preliminary alignment of the copy papers fed one by one to the intermediate tray A during the copying operation.

If the first copy flag is determined to be "1", the process flow proceeds to the step S601 (S600), and if the flag is "0", the process flow returns (S600). Whether the format overlay selection display LED 3001*a* is on or not is determined (S601). When the format overlaying is selected, the process flow proceeds to the step S602, in which whether a copy paper is newly fed to the intermediate tray or not is determined. The method for determining whether the copy paper is newly fed to the intermediate tray or not is not directly related to the present invention, so that the detailed description thereof will be omitted. A method may be employed in which the timer is operated after the timing roller 16 is turned on and after a prescribed time period, it is determined that a copy paper is newly fed, for example. If the copy paper is fed in the intermediate tray, the process flow proceeds to the step S603.

The copy paper preliminary alignment subroutine is called and the copy papers being fed are preliminarily aligned.

The details of the intermediate tray reception preparation subroutine of FIG. 8 and the copy paper preliminary alignment subroutine of FIG. 9 are not the main element of the present invention, so that the description thereof will be omitted.

Figure 10:
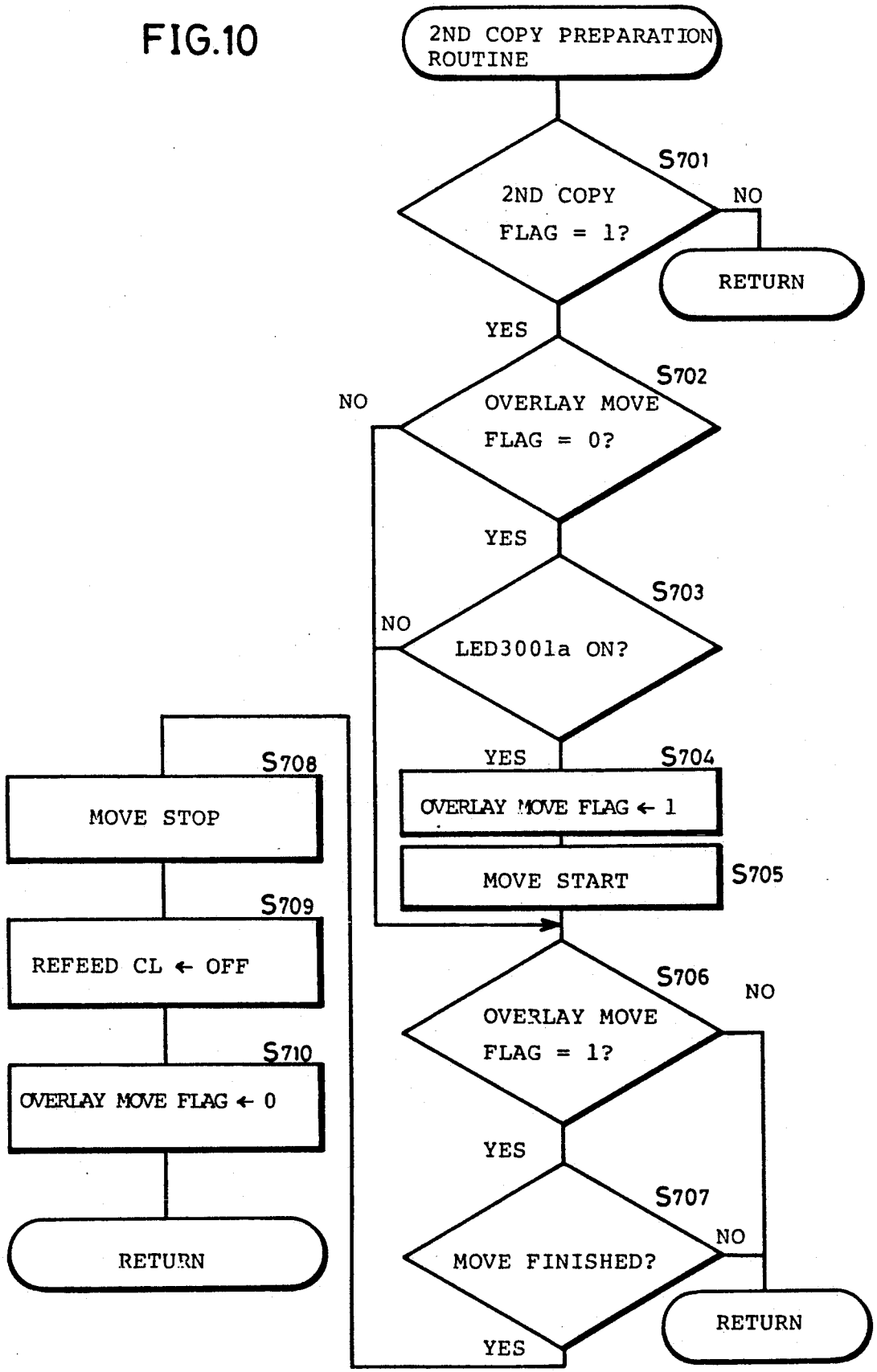
FIG. 10 is a flow chart showing the second copy preparation routine.
Figures 11, 11A:
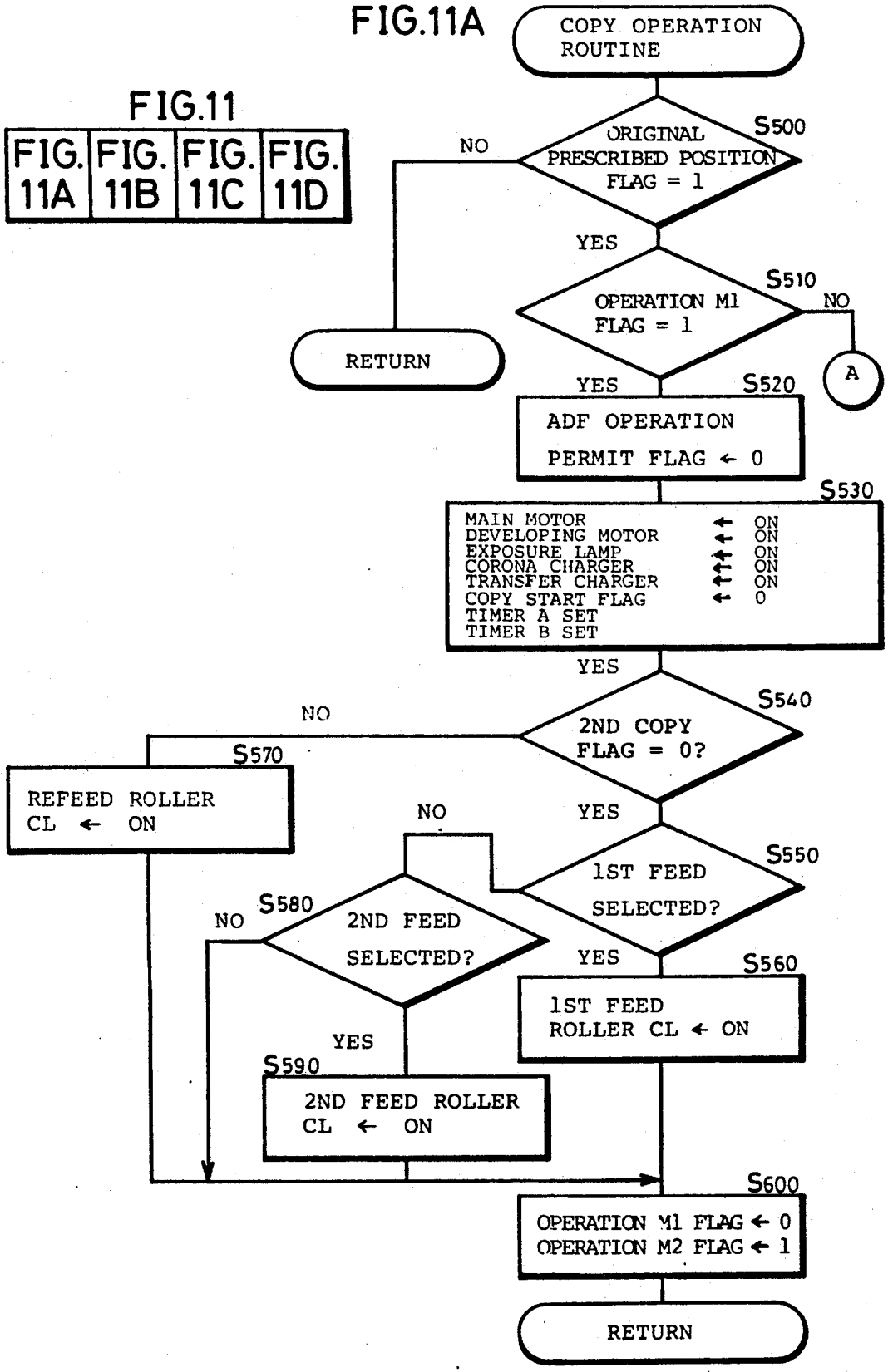
FIG. 11 is broken into four sections which are identified as FIGS. 11*a*, 11*b*, 11*c*, and 11*d* and these four comprise a flow chart showing the copying operation routine.
Figure 11B:
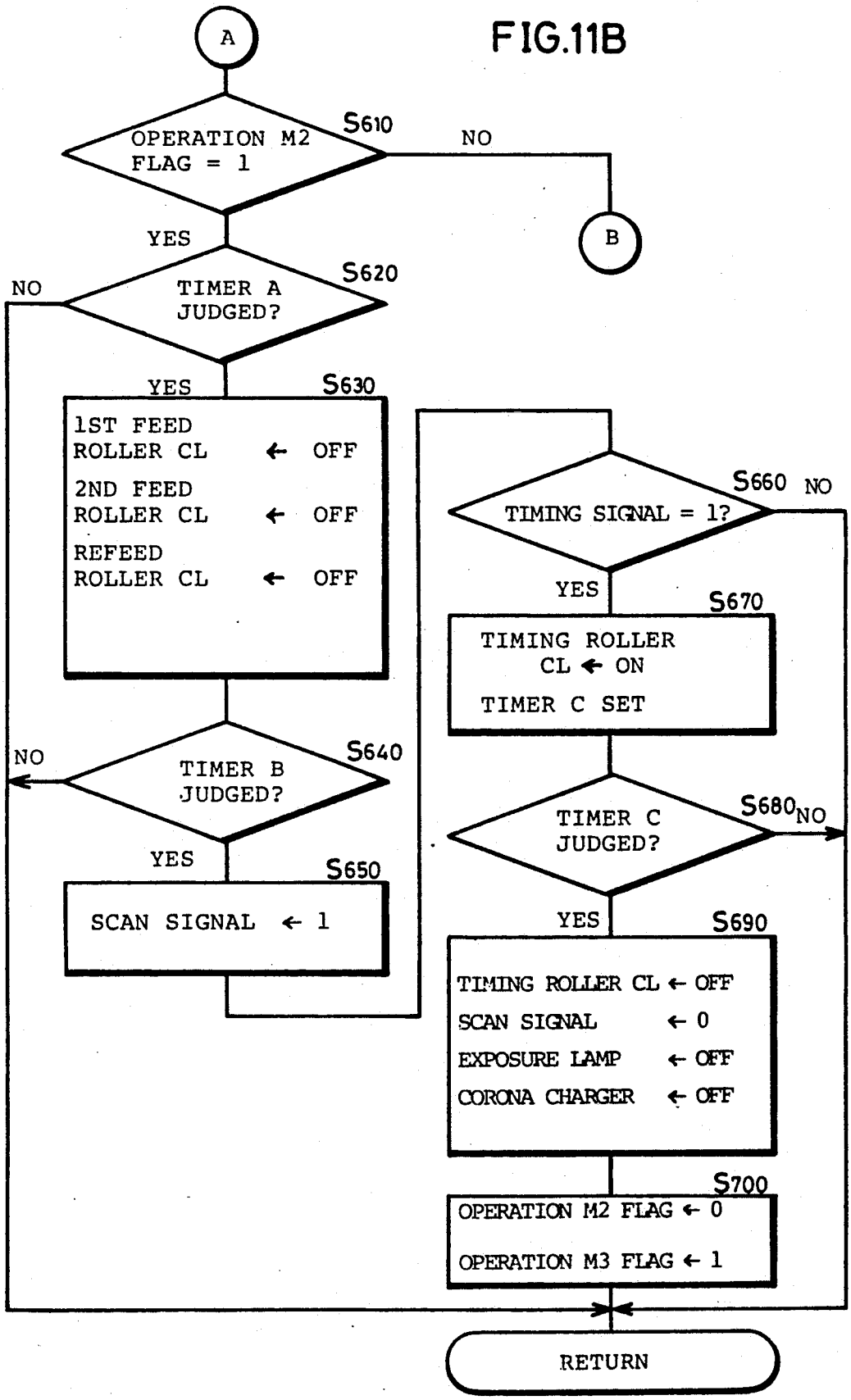
Figure 11C:
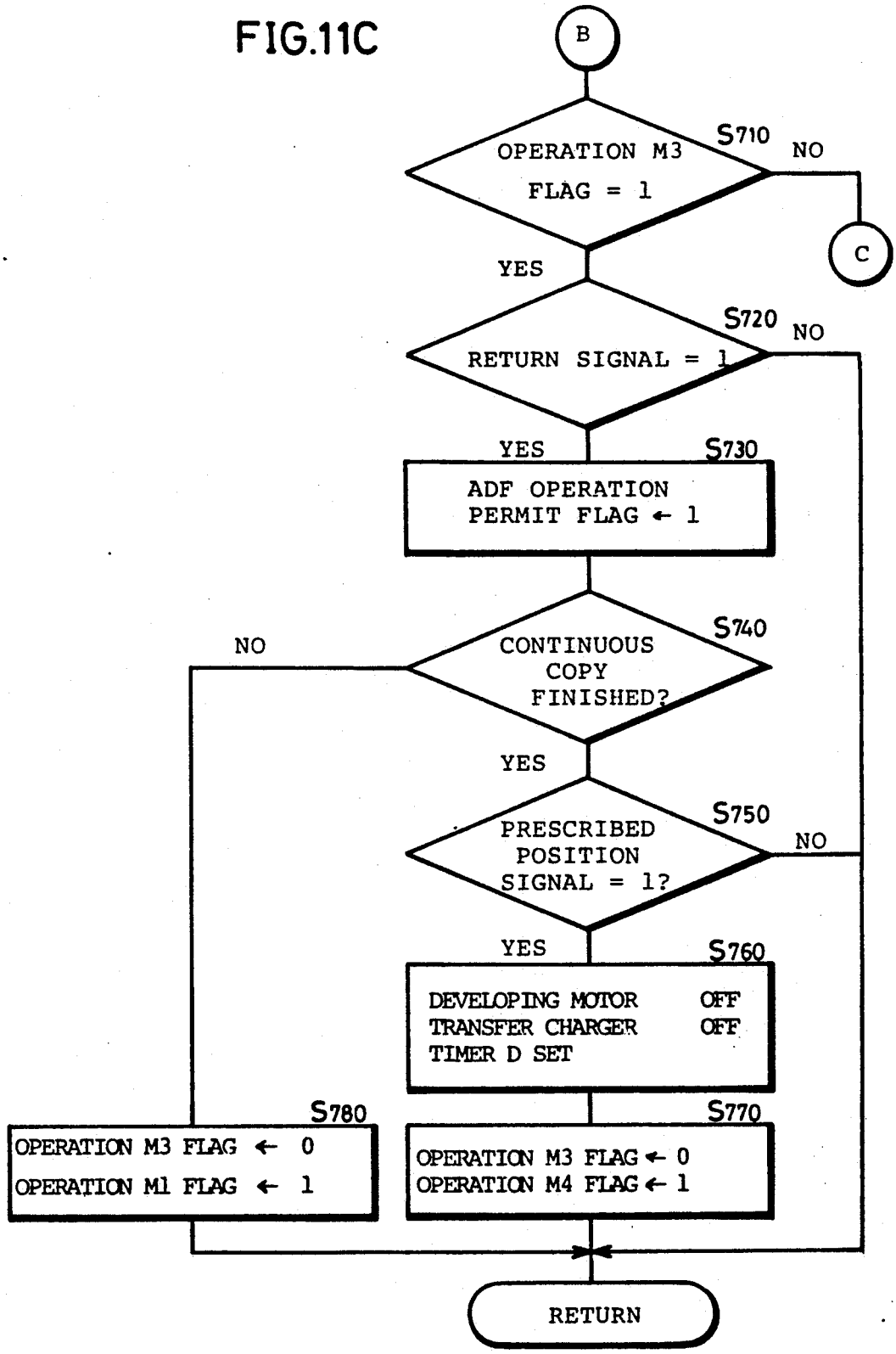
Figure 11D:
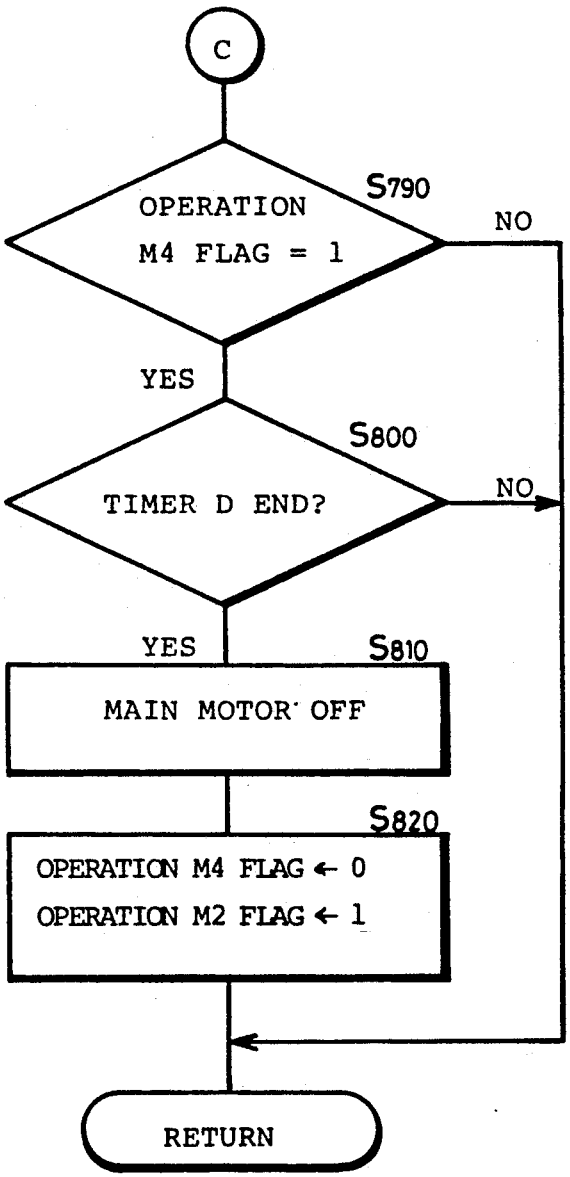

FIG. 10 shows a second copy preparation routine. The second copy preparation routine is a subroutine for aligning the front end, rear end and both sides of the copy papers fed and stacked in the intermediate tray A and for moving the same to the paper re-feeding opening B.

Whether the second copy flag is "1" or not is determined in the step S701. Whether the overlay moving flag is "0" or not is determined in the step S702. If the overlay moving flag is "0", the copy paper is moved to the paper re-feeding opening B at the time of format overlaying. Whether the format overlay copy selection display LED 3001*a* is on or not is determined in the step S703. If the LED 3001*a* is on, the above mentioned overlay moving flag is set at "1" in the step S704, and the copy papers stacked and aligned in the intermediate tray A are moved to the paper re-feeding opening B in the step S705.

It is checked in the step S706 whether the overlay moving flag is set at "1". Whether the movement is finished or not is determined in the step S707. When it is confirmed that the copy papers are moved to the paper re-feeding position, the movement of the copy papers are stopped in the step S708. In the step S709, the paper re-feeding clutch is turned off. The paper re-feeding roller 24 is pressed on the copy papers moved to the paper re-feeding position. The overlay moving flag is reset to "0" in the step S710, thus the subroutine ends.

FIGS. 11A to 11D are flow charts showing the copy operation routine. An original predetermined position flag is checked in the step S500. If the original predetermined position flag is "1", it means that the original is set on the original glass plate 25 and a copy can be taken. At the time, the process flow precedes to the step S510. If the original predetermined position flag is "0", it means that the original is not set and there is no need for a copying operation. Therefore, the process flow returns. In the step S510, the operation M1 flag is checked. If the operation M1 flag is "1", then the ADF operation permitting flag is reset to "0" in the step S520 so as not to activate the ADF.

Thereafter, the main motor is driven in the step S530. Consequently, the photoreceptor drum 2 is rotary driven and the transporting roller and the like of the copy papers are rendered drivable. The exposure lamp 10, the corona charger 6, the transfer charger 5*a* are turned on. The developing motor is turned on. The above mentioned copy start flag is reset to "0". A timer A for controlling the paper feeding system and a time B for controlling the optical system 1 are set.

Whether the second copy flag is "0" or not is determined in the step S540. If the format overlay copying is selected and the paper re-feeding is possible, the second copy flag is set at "1". On this occasion, the flow is determined to be NO in the step S540. In the step S570, the paper re-feeding roller clutch is turned on. One copy paper is re-fed from the intermediate tray A and the flow proceeds to the step S600.

In a usual one side copying, the flow is determined to be YES in the step S540. Whether the first paper feeding portion is selected or not is determined in the step S550 and whether the second paper feeding portion is selected or not is determined in the step S580. The paper feeding roller clutch of the paper feeding portion selected in the step S550 or S580 is turned on, one copy paper is fed, and the flow proceeds to the step S600. In the step S600, the operation M1 flag is reset ("0") and the operation M2 flag is set ("1").

Figure 1:
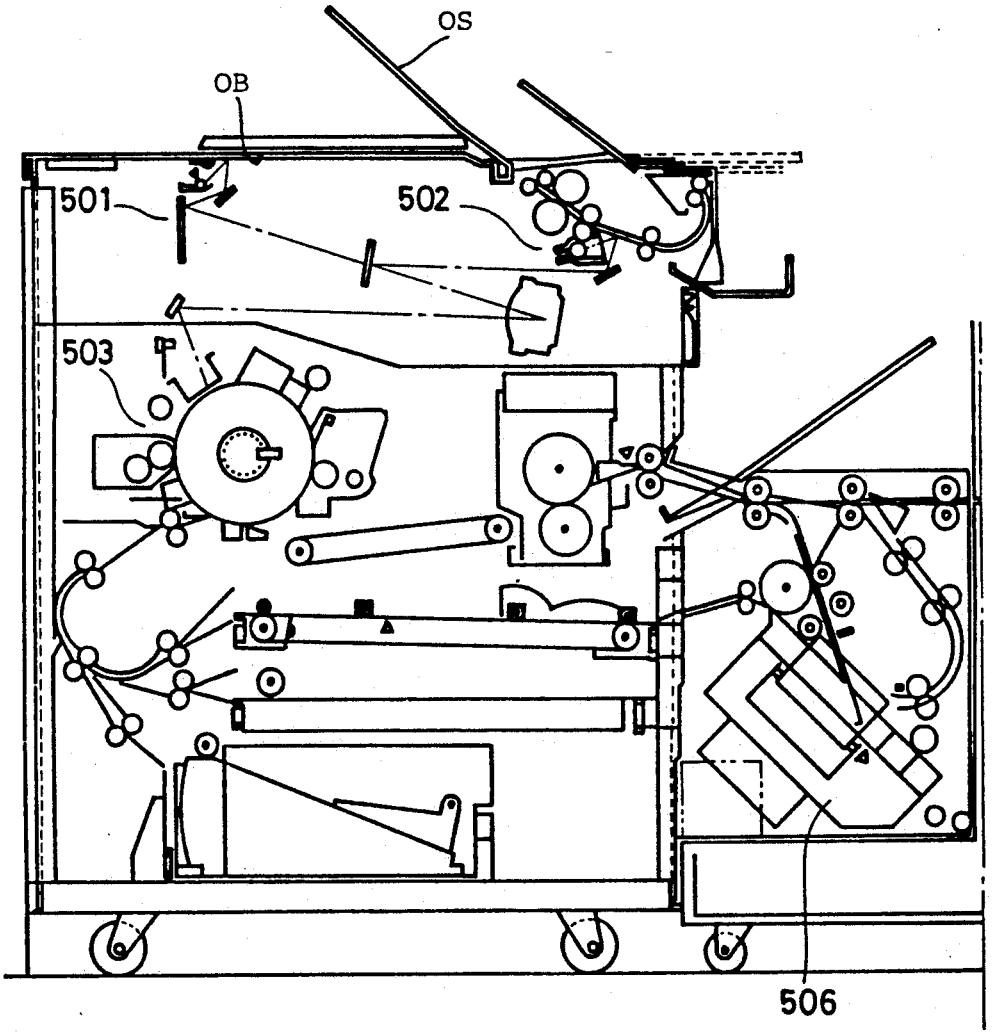
FIG. 1 is a cross sectional view of a conventional copying apparatus capable of composite copying.

If the operation M1 flag is "0" in the step S510, the flow proceeds to the step S610. In the step S610, the operation M2 flag is checked. If the operation M2 flag is "1", then the flow proceeds to the step S620 and, if it is "0", the flow proceeds to the step S710. In the step S620, the end timing of the above mentioned timer A is checked. If it is YES, the first and second paper feeding roller clutches and the paper re-feeding roller clutch is turned off in the step S630. In the step S640, the end timing of the timer B is checked. If it is YES, a scan signal is turned on in the step S650 and the scanning of the optical system 1 is effected in the direction of an arrow b of FIG. 1.

Whether the timing signal is turned on or not is determined in the step S660. Namely, whether the timing switch provided on the scanning track of the optical system 1 is turned on to feed a copy paper from the timing roller pair 16 or not is determined. If it is YES, the timing roller clutch is turned on in the step S670, a copy paper is fed to the transfer portion and the time C is set. In the step S680, the end timing of the timer C is checked.

In the step S690, the timing roller clutch is turned off and the scan signal is turned off. The exposure lamp 10 and the corona charger 6 are turned off. Thereafter, in the step S700, the operation M2 flag is reset and the operation M3 flag is set.

In the step S710, the operation M3 flag is checked and, if it is "1", the flow proceeds to the step S720.

In the step S720, the return signal is checked to be turned on and, when it is turned on, the process proceeds to the step S730. The return signal is turned on when the optical system 1 returns from the scan end position to the prescribed position. The scan end position is detected by the following method. Namely, by measuring scanning time from the prescribed position, providing a switch at the scan end position, and so on. These methods are not directly related tot the present invention, therefore the detailed description thereof will be omitted. In the step S730, the ADF operation permitting flag is set at "1" to permit the ADF operation. Whether the continuous copying is finished or not, that is, whether all copies are taken or not is determined in the step S740. If it is YES, the following operations are carried out so as to finish the copying operation. Namely, in the step S750, it is confirmed that the optical system 1 is returned to the movement start position by turning on of the prescribed position switch. In the step S760, the developing motor and the transfer charger 5*a* are turned off and the timer D is set. In the step S770, the operation M3 flag is reset and the operation M4 flag is set. The flow proceeds to the routine of checking the timer D. If it is determined that the continuous copying is not completed in the step S740, the flow proceeds to the step S780, where the operation M3 flag is reset and the operation M1 flag is set. Consequently, the copying operation again continues successively accompanied by the original feeding operation of the ADF.

If is it determined that the operation M3 flag is "0" in the step S710, the flow proceeds to the step S790. The operation M4 flag is checked in that step and, if it is "1", the flow proceeds to the step S800. When the end timing of the timer D is detected in the step S800, the main motor is turned off in the step S810 to stop the rotary drive of the photoreceptor drum 2. The operation M4 flag is reset and the operation M1 flag is set in the step S820. Consequently, it is ready for the operation of the next turning on of the print switch.

Figures 12, 12A:
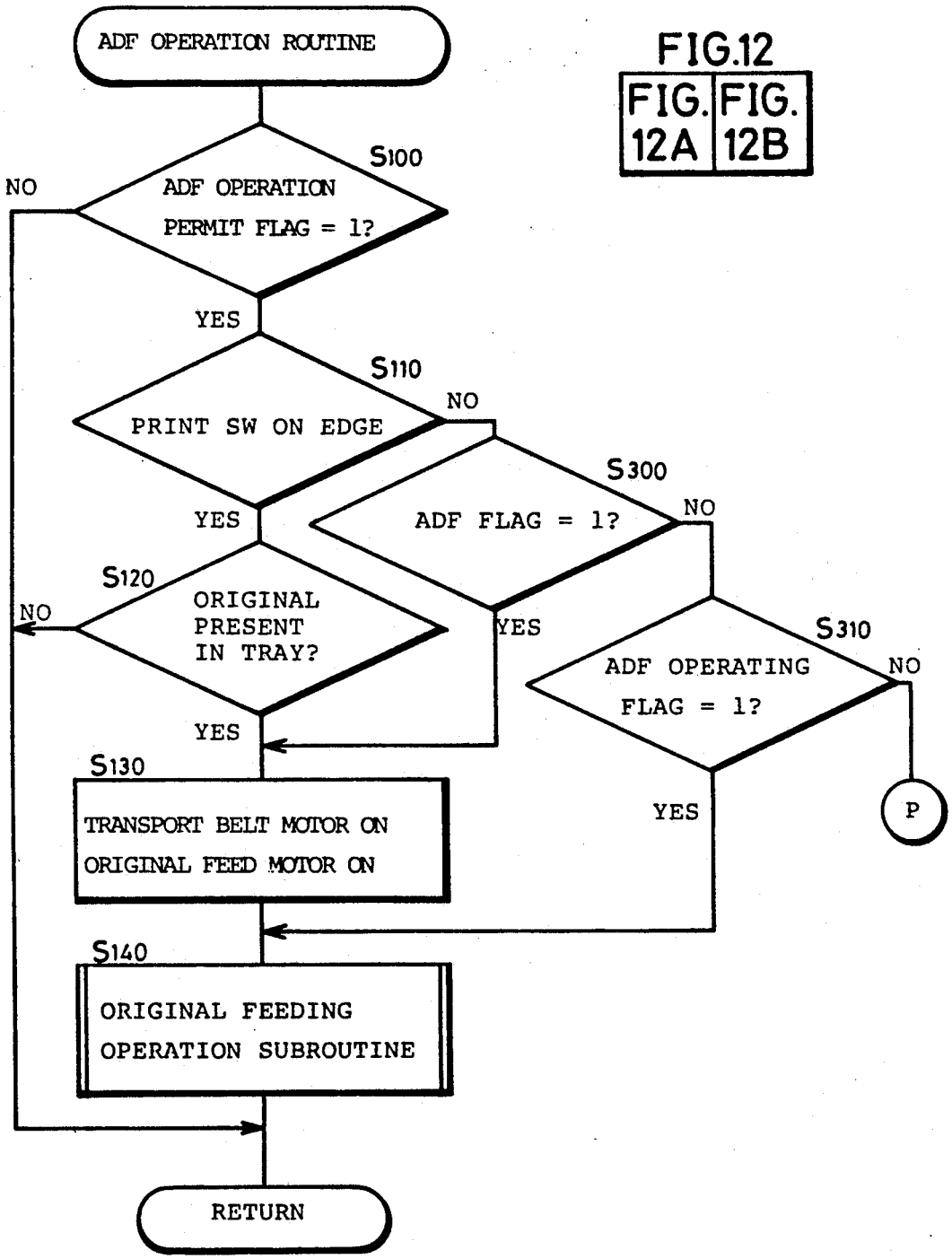
FIG. 12 is broken into two sections which are depicted in FIGS. 12*a* and 12*b*, and these two figures comprise a flow chart showing the ADF operation routine.
Figure 12B:
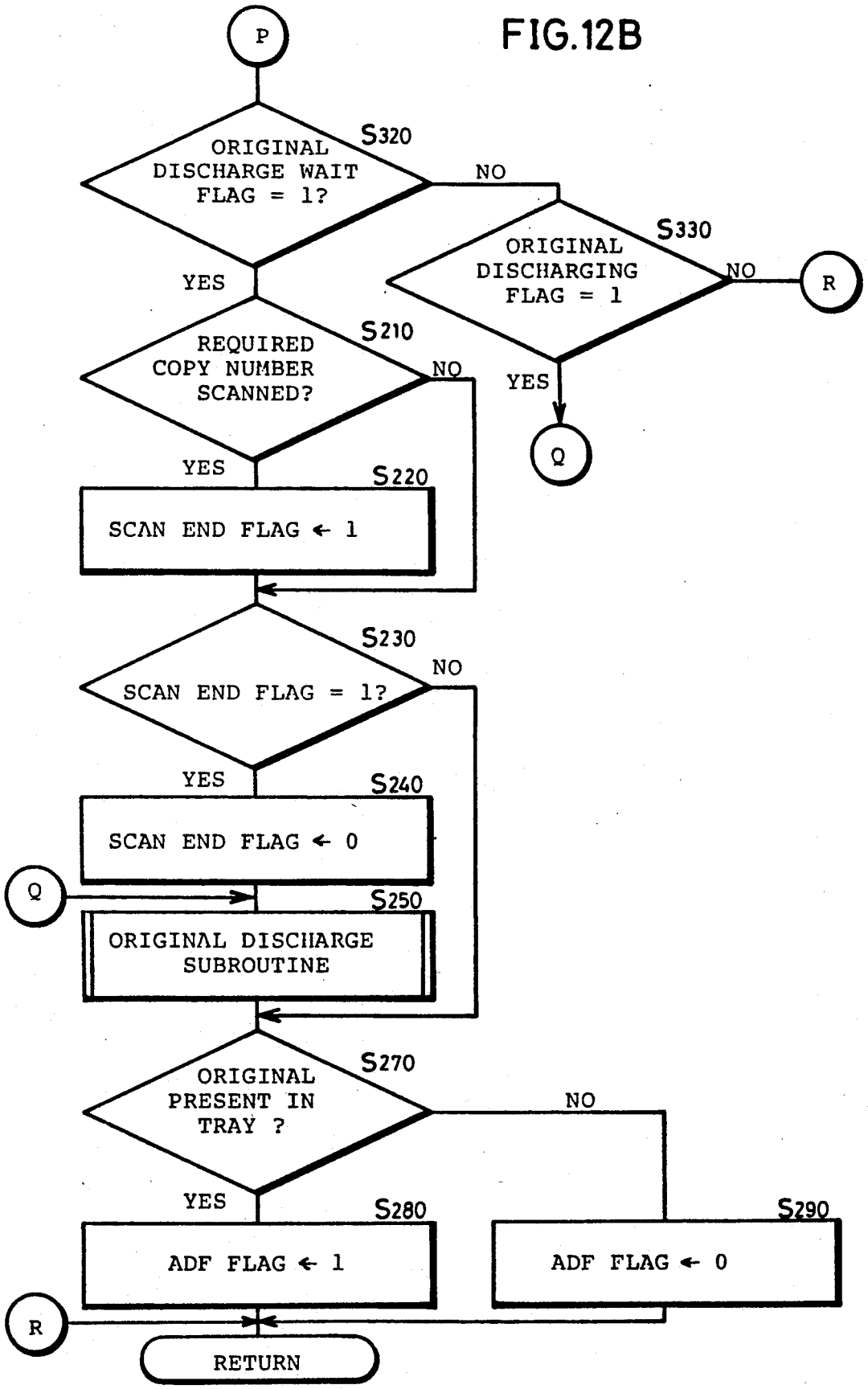

FIG. 12 is a flow chart showing the ADF operation routine. In the step S100, the ADF operation permitting flag is checked and, if it is "1", it means permitted and so the flow proceeds to the step S110. If it is "NO", the operation is not necessary, so that the flow returns. In the step S110, the on edge of the print switch 301 is checked. If it is YES, it is determined in the step S120 whether there is an original in the original tray or not, that is, whether the sensor SE3 is turned on or not. If it is YES, the original transporting belt motor and the original feeding motor are turned on and an original is placed on a prescribed position on the original glass plate 25 of the copying machine by the original feeding process subroutine (for the details, see FIG. 12). Even if it is determined NO in the step S110, the flow proceeds to the step S130 provided that the original automatic feeding flag is set in the step S300. Namely, even if the print switch on edge is not detected, the transportation of the original can be carried out when the original automatic feeding flag is set at "1". Therefore, if there is an original on the original tray of the ADF, the ADF is continuously operated. Whether the original feeding process flag is "1" or not is determined in the step S310 and, if it is YES, the flow proceeds to the step S140. The original processing flag is "1" when the original is being fed onto the original glass plate 25. In the step S320, whether the original discharge waiting flag is "1" or not is determined. If it is YES, the flow proceeds to the step S210. In the step S210, the scan end flag is set at "1" when the scanning of the set number of copies for originals placed on the original glass plate 25 is finished. In the steps S230 to S250, if the scanning end flag is "1", then it is made "0" and the copied originals are discharged to the discharge tray 38 by the original discharge process subroutine (for the details, see FIG. 13).

In the step S270, whether there is an original in the original tray or not is determined. If it is YES, the original automatic feeding flag is set in the step S280. If there is no original, it is determined NO, and the original automatic feeding flag is reset. The flow returns.

Figures 13, 13A, 13B:
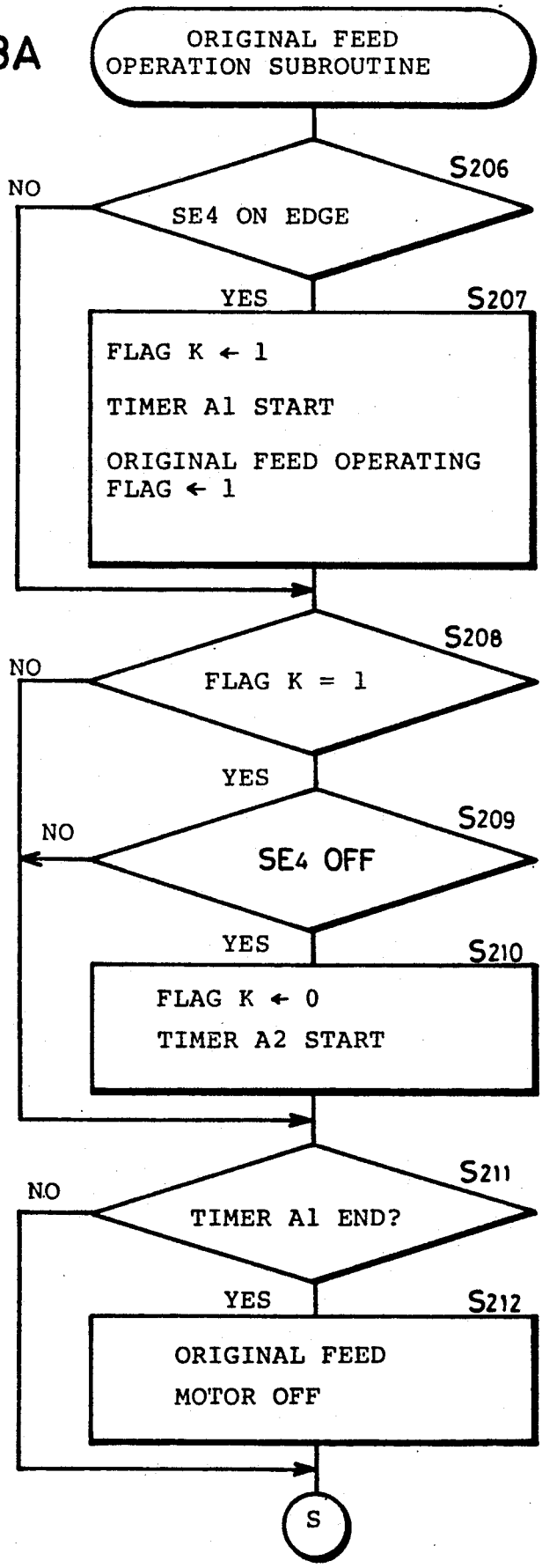
FIG. 13 is broken into two sections which are depicted in FIGS. 13*a* and 13*b*, and these two figures comprise a flow chart showing the details of the original feeding operation subroutine.
Figure 13B:
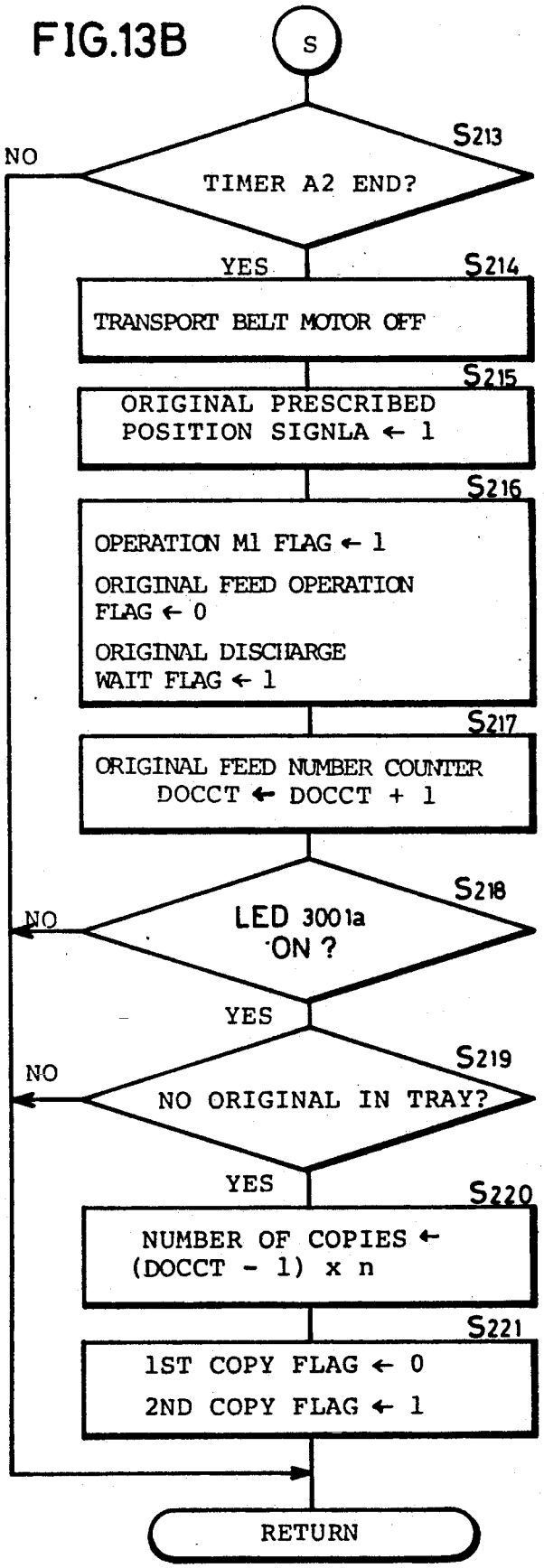

FIG. 13 is a flow chart showing the details of the original feeding process subroutine.

In the steps S206 to S207, when the front end of the original fed by the original feeding roller 35 is detected by the original sensor SE4, a flag K is set at "1". The flag K denotes that the original is passing the sensor SE4. At the same time, a timer Al for turning off the original feeding motor driving the original feeding roller 35 and the original feeding flag are set.

In the steps S208 to S210, when the rear end of the original is detected by the original sensor SE4, the flag K is made "0" and, a timer A2 for turning off the transporting belt motor driving the transporting belt 31 is set.

In the steps S211 and S212, if it is determined that the timer Al ends, the original feeding motor is turned off.

In the steps S213 to S215, if the end of the timer A2 is detected, the transporting belt motor is turned off and, simultaneously, the original prescribed position flag is set, which shows that the original is set at a prescribed position on the original glass plate 25.

Thereafter, in the step S216, the operation Ml flag is set, the original feeding processing flag is reset and the original discharging process waiting flag is set. In the step S217, the original feeding counter (DOCCT; document counter) is incremented. Thereafter, in the step S218, whether the LED 3001*a* is on or not is determined. If it is YES, it means that the format overlay copying is selected, so that the flow proceeds to the step S219. In the step S219, whether there is an original in the original tray or not is determined. If there is no original, it is determined that the original which is presently set on the prescribed position on the original glass plate 25 is the final original, and the number of copies on which format overlay copying should be carried out is counted.

More specifically, assuming that the number of originals is N+1 and n copies are required for each of the N originals except the final original, the number of copies for the format overlay copying will be N×n. Namely, N×n copied papers exist in the intermediate tray A and the content of the final original is overlay copied on these copied papers. Therefore, in the step S221, the second copy flag is set at "1" and the first copying flag is made "0", whereby the preparation for the format overlay copying is finished.

Figure 14:
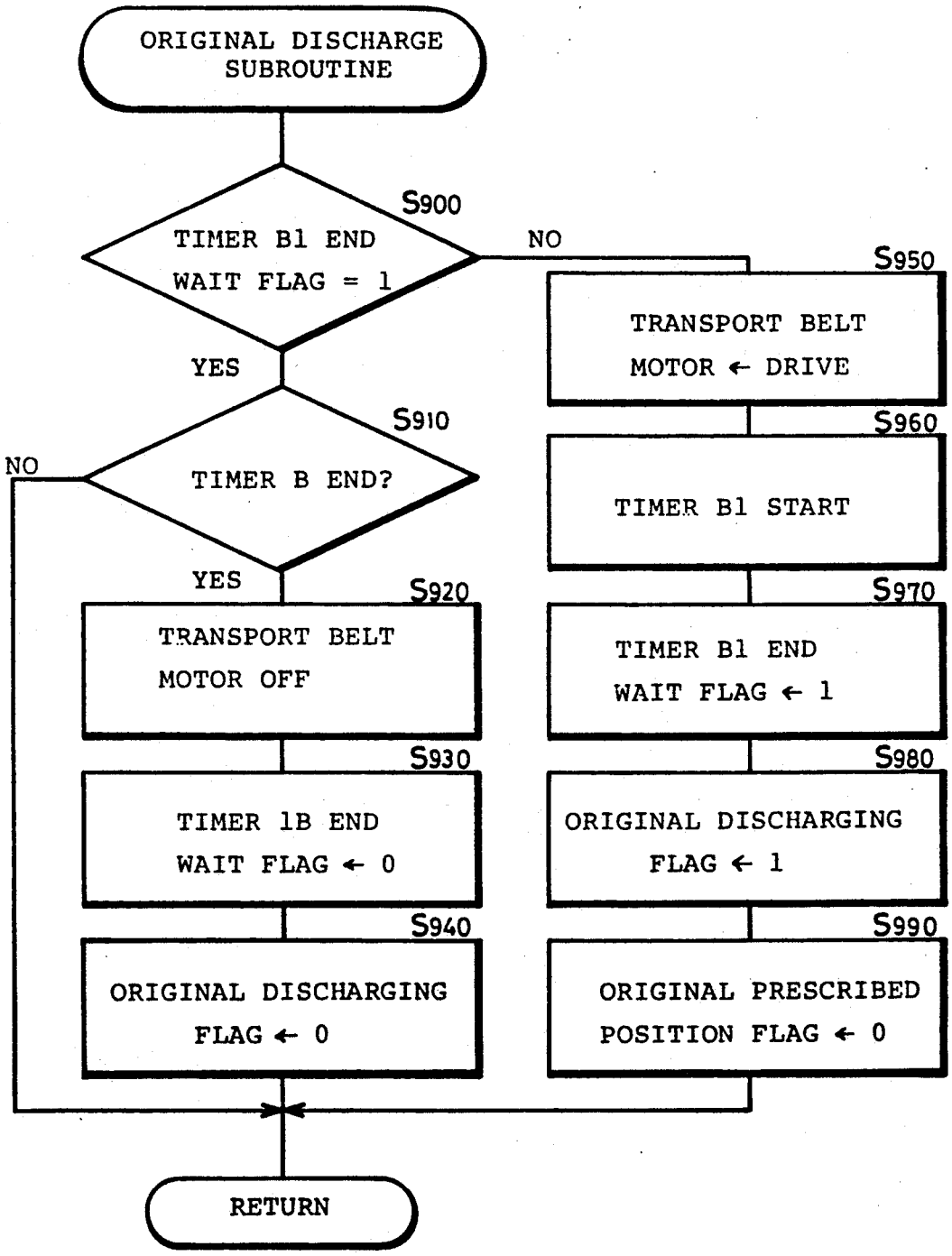
FIG. 14 is a flow chart showing the details of the original discharge operation subroutine.

FIG. 14 is a flow chart showing the details of the original discharge process subroutine. In the step S900, the end wait flag for the timer B1 is checked. The timer B1 determines the time period for operating the transporting belt motor. When the flow first reaches S900, the timer B1 flag is "0", so that it is determined NO, and the flow proceeds to the step S950. In the step S950, the transporting belt motor is driven and the original discharging operation starts. In the step S960, the timer B1 starts. In the step S970, wait flag for the timer B1 is set ("1"). In step S980, a flag is set which denotes that the original discharging process is being carried out. Since no original exist in the prescribed position, the original prescribed position flag is reset ("0").

When the timer B1 is started, the timer B1 waiting flag is "1" and the flow is determined YES in the step S900. In the step S910, the completion of the time set by the timer B1 is checked. If the time set by the timer B1 is not elapsed, the flow directly returns. If the time set by the timer B1 is elapsed, the original is determined to be discharged. Consequently, the transporting belt motor is turned off in the step S920. In the step S930, the timer B1 and wait flag is reset. In the step S940, the original discharge process flag is reset. When the original discharge subroutine is finished, the flow returns. In the above described manner, the format overlay copying is performed.

In the foregoing, description was given of a case in which each of the 1st to Nth originals and the N+1th original are copied on the same copy side. Each of the 1st to Nth originals may be copied on the upper surfaces of the copy papers and the N+1th original may be copied on the opposite surfaces of the respective copy papers. In that case, the clutch of the lever 23 should be turned off in the step S522 of FIG. 8.

In the above described embodiment, the number of copies are set as N×n for the N+1th original, however, the copying operation may be continuously carried out until copy papers in the intermediate tray A are exhausted, without especially setting the number of copies. In order to do so, copy paper detecting means should be provided in the intermediate tray A. The continuous copying is stopped after the final copy paper is detected by the copy paper detecting means.

Although the present invention has been described and illustrated in detail, it is clearly understood that the same is by way of illustration and example only and is not to be taken by way of limitation, the scope of the present invention being limited only by the terms of the appended claims.

What is claimed is:

1. A copying apparatus comprising:
   - copying means for copying original images onto copy papers;
   - original feeding means for feeding said originals one by one to said copying means;
   - detecting means for detecting that a final original of said originals is fed to the copying means;
   - first feeding means for feeding copy papers one by one to said copying means;
   - second feeding means for refeeding said copy papers with images formed on one side thereof by said copying means; and
   - changing means responsive to said detecting means for changing feeding actuation from the first feeding means to the second feeding means.

2. A copying apparatus according to claim 1, further comprising:
   - a copy number inputting means for inputting numbers to be copied for each of said originals;
   - counting means for counting the number of originals fed by said original feeding means; and
   - determining means for determining the number of copies of the final original based on the input value and the counting value.

3. A copying apparatus according to claim 1, wherein said copying means copies the final original image onto said one side of said copy paper.

4. A copying apparatus according to claim 1, wherein said copying means copies the final original image onto the other side of said copy paper.

5. A copying apparatus comprising:
   - original placing means for containing a plurality of originals, wherein said plurality of originals include a final original and other originals;
   - copying means having a single exposure portion for exposing said originals and for forming images of said exposed originals on copy paper, wherein said copying means carries out copying in a first mode and a second mode;
   - original feeding means for feeding the originals on said original placing means one by one to said exposure portion;
   - detecting means for detecting when said final original is fed from said original feeding means;
   - first paper feeding means for containing first papers and for feeding the first papers one by one to said copying means in the first mode;
   - second paper feeding means for containing second papers for feeding the second papers one by one to said copying means in the second mode; and
   - control means responsive to said detecting means for controlling said copying means such that said final original is copied in said second mode and said originals other than the final original are copied in said first mode.

6. A copying apparatus according to claim 5, which further comprises copy number input means for inputting numbers to be copied for each of said originals in said first mode.

7. A copying apparatus according to claim 6, which further comprises counting means for counting the number of originals fed by said original feeding means.

8. A copying apparatus according to claim 7, wherein the number of copies of said final original is determined by a value inputted to said copy number input means and by a value counted by said counting means in said second mode.

9. A copying apparatus comprising:

original placing means for containing a plurality of originals, wherein said plurality of originals include a final original and originals other than the final original;

copying means for forming images of said plurality of originals on a copy paper, said copying means having a single exposure means for exposing said plurality of originals;

original feeding means for feeding said plurality of originals on said original placing means one by one to said exposure means;

detecting means for detecting which of said plurality of originals on said original placing means is said final original;

paper containing means for containing copy papers on which the images are to be formed;

paper feeding means for feeding said copy papers from said paper containing means one by one to said copying means;

intermediate paper containing means for receiving copied papers with images formed on one side thereof by said copying means and temporarily containing them therein;

paper re-feeding means for feeding said copied papers from said intermediate paper containing means one by one to said copying means; and control means responsive to said detecting means for activating said paper feeding means when originals other than said final original is fed by said original feeding means and for activating said paper re-feeding means when said final original is fed by said original feeding means.

10. A copying apparatus according to claim 9, wherein each of said copied paper contained in the intermediate paper containing means have the image of the original other than the final original on one side thereof; and said paper re-feeding means supplies said copied papers to said copying means so that the image of the final original is formed on said one side of the copied papers.

11. A copying apparatus according to claim 9, wherein each of said copied papers contained in the intermediate containing means have the image of the original other than the final original on one side thereof; and said paper re-feeding means supplies said copied papers to said copying means such that the image of the final original is formed on the other side of the copied papers.

12. A copying apparatus comprising:

original placing means for containing a plurality of originals, wherein said plurality of originals include a special original and other originals;

copying means having a single exposure portion for exposing said plurality of originals and for forming images of said exposed originals on copy papers, wherein said copying means carries out copying in a first mode or a second mode;

original feeding means for feeding said plurality of originals on said original placing means one by one to said exposure portion;

detecting means for detecting which of said plurality of originals on said original placing means is said special original;

first paper feeding means for containing first papers and for feeding the first papers one by one to said copying means when said copying means is copying in the first mode;

second paper feeding means for containing second papers and for feeding the second papers one by one to said copying means when said copying means is copying in the second mode; and control means responsive to said detecting means for controlling said copying means such that said special original is copied in said second mode and said originals other than the special original are copied in said first mode.

13. A copying apparatus according to claim 12, wherein said copying means includes;

a photoreceptor, image forming means for forming images of said originals on said photoreceptor, and transfer means having a transfer position for forming the images formed on said photoreceptor to said copy paper at said transfer position;

said first paper feeding means feeds the first paper to said transfer position; and said second paper feeding means includes;

storing means for temporarily storing the first papers on which said images are transferred as a second paper, and paper re-feeding means for re-feeding said stored copy papers in the storing means to said transfer position.

14. A copying apparatus according to claim 13, wherein said copy paper comprises one side and the other side, and said copy control means controls such that said images are formed only on the one side of said copy paper in said first and second modes.

15. A copying apparatus according to claim 13, wherein said copy paper comprises one side and the other side, and said copy control means controls such that said images are formed respectively on said one side and the other side in said first and second modes.

16. In a copying apparatus having;

copying means including a single exposure portion for exposing an original and an image forming portion for forming images of said original on a copy paper by said exposure;

original feeding means having an original placing portion for placing a plurality of said originals and for feeding said originals one by one to said exposure portion;

detecting means for detecting when a final original of said plurality of originals has been fed by said original feeding means;

first storing means for storing copy paper to be copied;

paper feeding means for feeding copy papers stored in said first storing means to said image forming portion;

second storing means for temporarily storing said copying papers on which images are formed; and paper re-feeding means for feeding said copy papers in said second storing means again to said image forming means;

a method of copying images comprising the steps of:

placing a plurality of originals on said original placing portion of the original placing means, said plurality of originals include a final original and originals other than the final original;

feeding the originals other than the final original one by one to said exposure portion from said original placing portion and feeding the copy paper stored in said first storing means successively to said image forming means;

copying the images of each original other than the final original on the desired number of copy papers fed from the first storing means;

storing said copied papers in said second storing means;

feeding said final original from said original placing portion to said exposure portion and re-feeding the paper stored in said second storing means successively to said image forming means; and copying the image of the final original on the copy papers re-fed from the second storing means;

whereby images of said final original are copied on said copied paper.

17. In a copying apparatus having;

image forming means having a single exposure portion for exposing an original and for forming images of said original on a copy paper by said exposure;

original feeding means having an original placing portion for feeding a plurality of said originals disposed on said original placing portion one by one to said exposure portion; and detecting means for determining when a final original of said plurality of originals is fed from said original feeding means;

paper re-feeding means for temporarily storing said copy papers on which images are formed in an intermediate tray and for re-feeding the same to said image forming means;

a method for copying images comprising the steps of:

setting N+1 originals onto the original placing portion;

feeding said first to Nth originals successively from said original placing portion;

detecting when said N+1th original is fed from said original placing means;

forming copy papers of said originals by feeding said originals to said exposure portion by said original feeding means;

containing said copied papers in said intermediate tray;

feeding said copied papers stored in said intermediate tray successively to the image forming means; and forming images of the N+1th original on said copied papers.

* * * * *